US007255137B2

(12) United States Patent
MacDonald

(10) Patent No.: US 7,255,137 B2
(45) Date of Patent: Aug. 14, 2007

(54) PETROLEUM SPILL CONTAINMENT SYSTEM

(76) Inventor: William David MacDonald, 1431 Kocher St., Huntington, IN (US) 46750

( * ) Notice: Subject to any disclaimer, the term of this patent is extended or adjusted under 35 U.S.C. 154(b) by 118 days.

(21) Appl. No.: 11/083,150

(22) Filed: Mar. 17, 2005

(65) Prior Publication Data

US 2005/0205153 A1 Sep. 22, 2005

Related U.S. Application Data

(60) Provisional application No. 60/553,840, filed on Mar. 17, 2004.

(51) Int. Cl.
*B65B 1/04* (2006.01)

(52) U.S. Cl. ..... 141/86; 141/311 A; 220/573; 184/106

(58) Field of Classification Search ..... 141/86, 141/87, 98, 311 A; 220/573, 571; 184/106
See application file for complete search history.

(56) References Cited

U.S. PATENT DOCUMENTS

| | | | | | |
|---|---|---|---|---|---|
| 3,612,329 | A * | 10/1971 | Parks et al. | ..... | 220/565 |
| 4,246,982 | A * | 1/1981 | Pretnick | ..... | 184/106 |
| 5,316,175 | A * | 5/1994 | Van Romer | ..... | 220/573 |
| 5,816,743 | A * | 10/1998 | Schmitz, Jr. | ..... | 405/53 |
| 6,301,848 | B1 * | 10/2001 | Whitaker | ..... | 52/302.1 |
| 6,715,517 | B2 * | 4/2004 | Tobin | ..... | 141/86 |

* cited by examiner

*Primary Examiner*—Steven O. Douglas

(57) ABSTRACT

A spilled fuel containment apparatus including a drive-on substrate and at least one side that is substantially vertically extendable. The at least one side being substantially fluidically sealed with the substrate when the at least one side is substantially vertical.

20 Claims, 7 Drawing Sheets

PETROLEUM SPILL CONTAINMENT SYSTEM

CROSS-REFERENCE TO RELATED APPLICATIONS

This is a non-provisional patent application based upon U.S. Provisional Patent application Ser. No. 60/553,840 bearing the title "Petroleum Spill Containment System" filed on Mar. 17, 2004.

BACKGROUND OF THE INVENTION

1. Field of the Invention

The present invention relates to a system and method for containing a potential fuel spill.

2. Description of the Related Art

Environmental protection regulations implement a requirement that any delivery of a petroleum product will require a spill containment system at the delivery point to prevent spills from finding their way to a ground surface. One containment system that is utilized in fuel receiving points is a birmed earth area into which a vehicle—for example, a truck—enters. The birmed area is made of a material that will contain fuel in the event of a spill in the filling of a truck. However, this creates a problem for the thousands of distribution points, such as convenience stores, which do not have the capacity or parking area to give over a section for a birmed area relative to fuel delivery. Further, these sorts of solutions require separating equipment to separate water that will accumulate in such areas and separate it from any petroleum that may be spilled therein. Further, a problem with this sort of system is that ice and snow can accumulate and effectively nullify the advantage of a birmed area.

What is needed in the art is a system that contains a spill without leaving obstacles in a parking lot.

SUMMARY OF THE INVENTION

The present invention provides an apparatus and a method for the containment of spilled petroleum.

The invention comprises, in one form thereof, a spilled fuel containment apparatus including a drive-on substrate and at least one side that is substantially vertically extendable. The at least one side being substantially fluidically sealed with the substrate when the at least one side is substantially vertical.

An advantage of the present invention is that a vehicle can easily move upon the system and a protection boundary is quickly positioned.

Another advantage of the present invention is that the system can be driven across by non-delivery vehicles.

Yet another advantage of the present invention is that it precludes the delivery of fuel until the walls are in position to protect against dissemination of spilt fuel.

Still yet another advantage of the present system is that it can be easily cleared of snow an ice.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION OF THE PRESENT INVENTION

Figure 1:
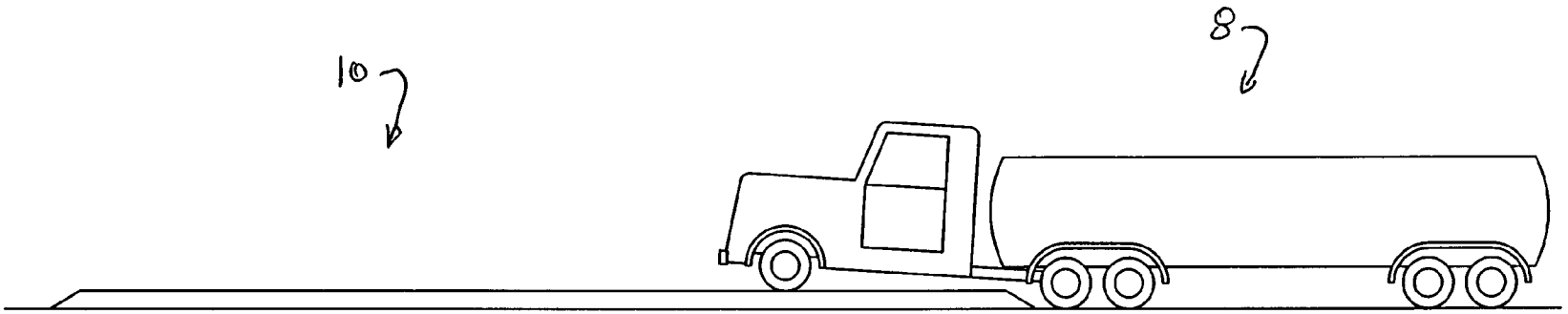
FIG. 1 is a side view of an embodiment of a petroleum spill containment system of the present invention being approached by a truck.
Figure 2:
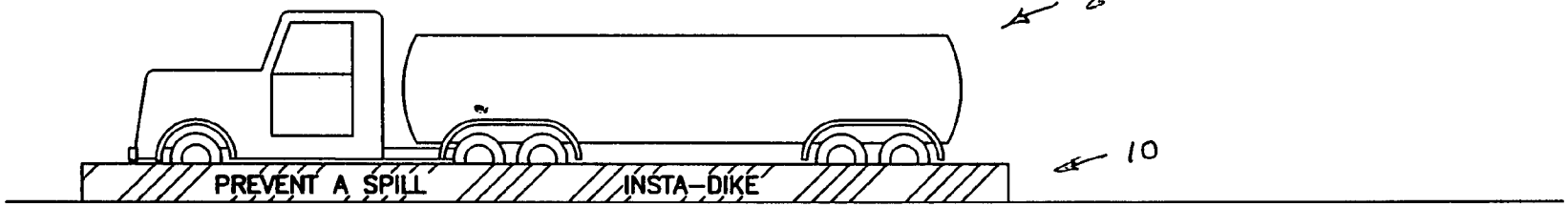
FIG. 2 is another side view of the system of FIG. 1 with the truck thereon.

Referring now to the Figures, and more particularly to FIGS. 1-6, there is shown a spill containment system 10 including sidewalls 12, endwalls 14, substrate 18, hinges 20 and 22. A tanker truck 8 drives up onto device 10 and positions the tanker portion on substrate 18 also known as a floor 18. The truck driver ensures that the tank is properly positioned and then actuates walls 12 and 14 to bring them from an inclined position up to a vertical or quasi-vertical position, thereby forming a box around tanker 8 located on floor 18. Hinges 20 and 22, or the edges of walls 12 and 14, seal against the edges of floor 18. For example, flexible seals 30 along the edges of walls 12 and 14 allow for a sealing of the edges of device 10.

Actuating cylinders 24, which actuate the movement of walls 12 and 14, may be air-driven cylinders that are powered by the air system from the delivery truck itself, thereby allowing device 10 to be independent of the need for power and control mechanisms apart from the delivery truck itself. Alternatively, cylinders 24 may be an actuating device 24 connected to walls 12 and 14 that are powered from a power source provided for device 10 at the site in which it is used, such as a hydraulic cylinder 24. Device 10 includes an under-support system 26 and is slightly raised above ground level to allow the positioning of actuators 24 therein. When the fuel delivery is completed and the tanker is secured, actuators 24 have pressure and/or vacuum removed therefrom, allowing walls 12 and 14 to reorient in an inclined position such as that shown in FIGS. 3 and 6. This allows a parking lot to be utilized with only the slight inconvenience of a ramped surface in the parking lot.

Additionally, device 10 may be more permanently installed and be situated such that floor 18 is level with the surrounding parking lot and walls 12 and 14 are likewise substantially positioned in a flat orientation in a parking lot. The activation of actuators 24 may be undertaken by activating controls located in a recessed access panel close to one of actuators 24. Actuators 24 are controllably interconnected in a manner know by those in the art of pneumatic and hydraulic devices.

Advantageously, the present invention allows tanker truck 8 to position itself on floor 18 while at least one of walls 14 is in a lowered position. Walls 12 and 14 are then elevated to a substantially vertical position. Device 10 allows the delivery of fuel while meeting the EPA regulations to contain spills. Device 10 allows for the meeting of the EPA requirements with a minimal amount of time on the part of the delivery person. Further, device 10 may be delivered in sections and constructed on-site or even include a skin in which a support structure, such as concrete, is poured. Components such as floor 18 and walls 12 and 14 include material that is nonporous to petroleum products and will not break down from repeated use and contact with petroleum products.

Figure 7:
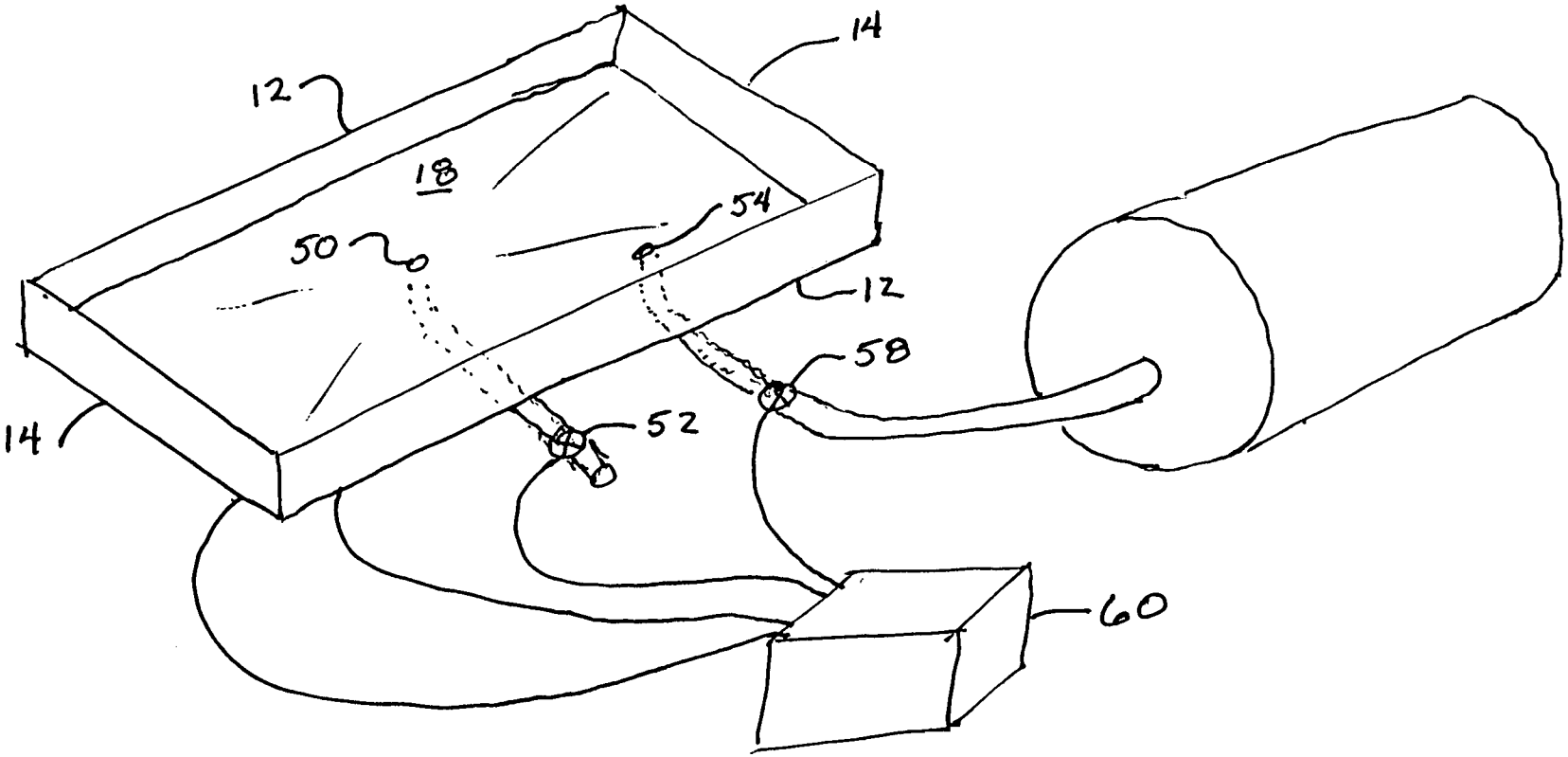
FIG. 7 is a perspective and schematical view of an embodiment of a petroleum spill containment system of the present invention.
Figure 8:
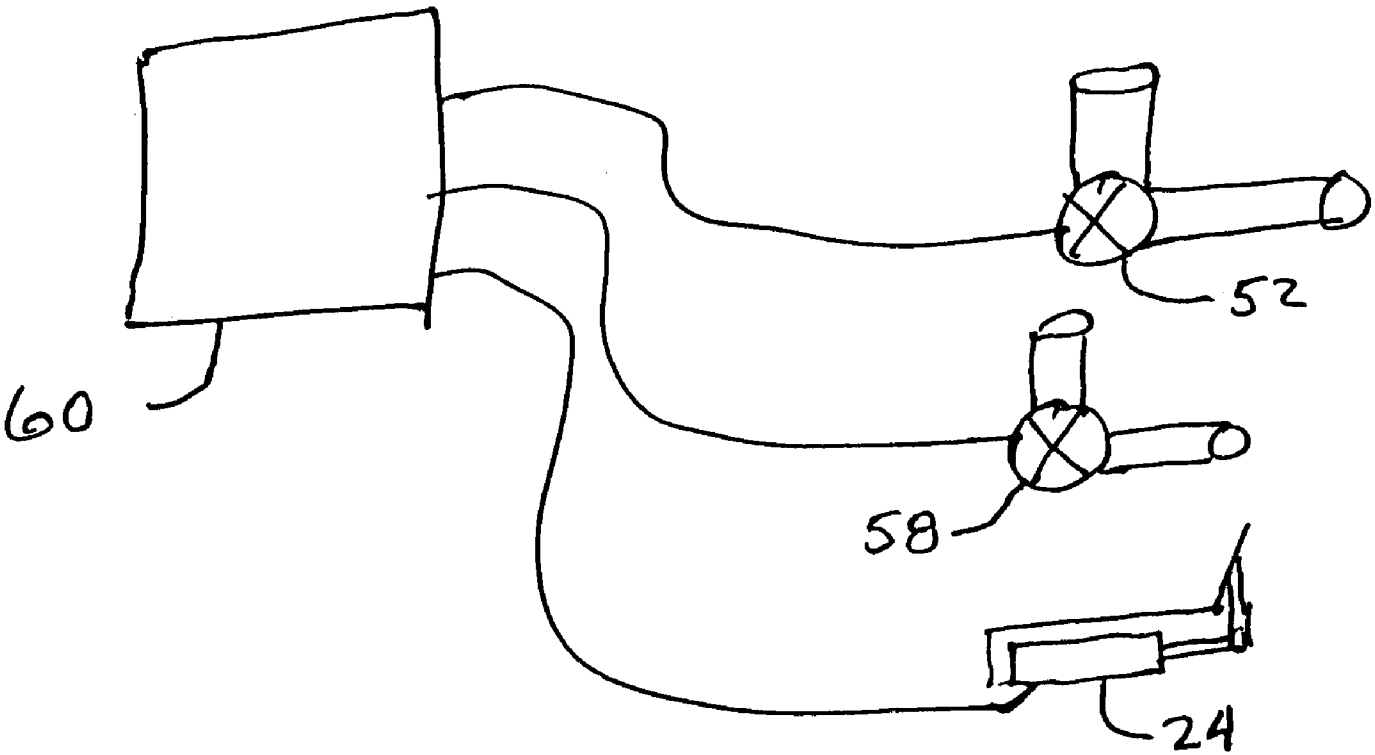
FIG. 8 is a schematic view of the control system of FIG. 7.

Now additionally referring to FIGS. 7 and 8, floor 18 may be sloped to a drain 50 having a drain valve 52, which is closed while walls 12 and 14 are in a raised position. In the event of a spill the drain can be coupled to a drain hose and pump, and the valve manually opened for the removal of the spilt petroleum.

Further, floor 18 may have a fill tube 54 that leads to a storage tank. Fill tube 54 may penetrate the floor allowing hoses from the truck to be entirely contained in device 10. Fill tube 54 may additionally have associated with it a fuel valve 58 interconnected with control system 60. Control system 60 interacts with drain valve 52 and sidewalls 12 and end walls 14. Control system 60 operatively raises walls 12 and 14, and when walls 12 and 14 are in their raised, upright position, drain valve 52 is closed and fuel valve 58 is opened, thereby allowing the delivery of fuel through fill tube 54. Control system 60 advantageously closes drain valve 52 in order to contain any spill that may take place in apparatus 10. Actuators 24 are controllably activated by control system 60. The control results in the prevention of off-loading fuel from truck 8 until sides 12 and 14 are raised to contain a potential spill, since valve 58 is not opened until sides 12 and 14 are raised. Manual overrides are provided for emergency opening of fuel valve 58 and drain valve 52.

In the event of a spill that is contained within device 10, an operator would connect a draining pipe so as to be fluidly connected through drain 50 by way of drain valve 52. Once connected, drain valve 52 is opened to allow the spilled fuel to drain toward drain 50 and the fuel to be pumped into another container (not shown), thereby preventing a spread of the spilled fuel.

Figure 3:
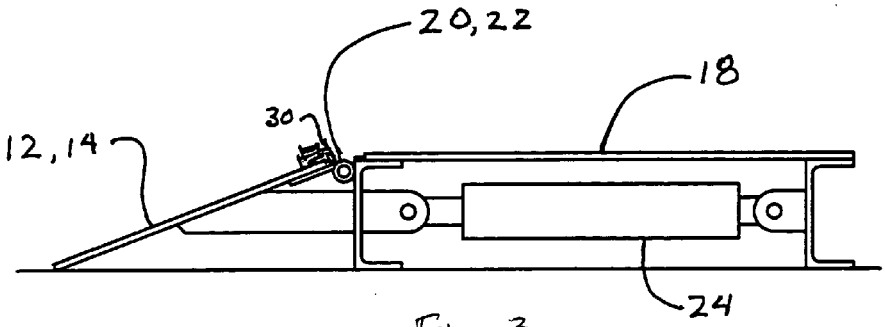
FIG. 3 is a partially sectioned side view of the sides of the system of FIGS. 1 and 2.
Figure 4:
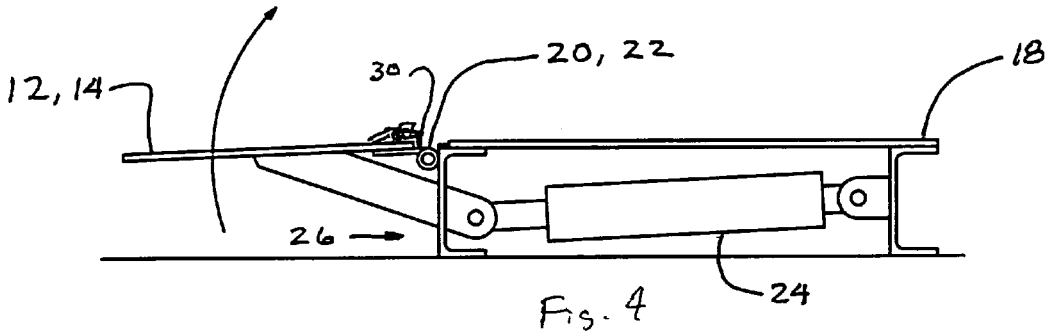
FIG. 4 is another view of the side illustrated in FIG. 3.
Figure 5:
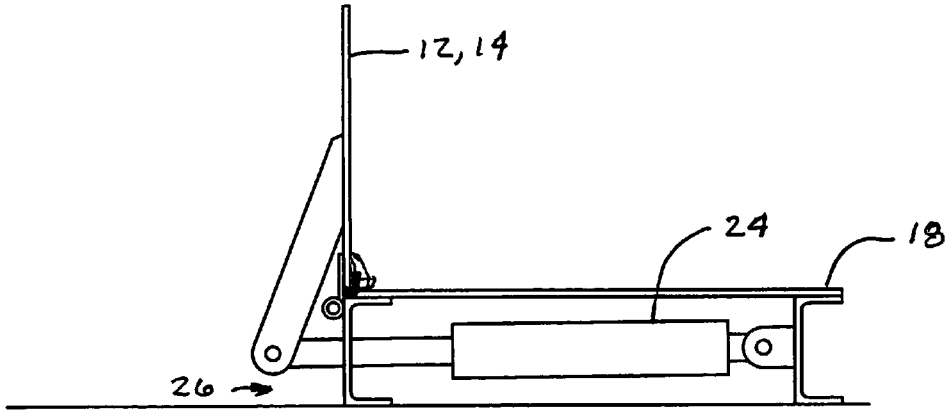
FIG. 5 is yet another view of the side illustrated in FIGS. 3 and 4.
Figure 6:
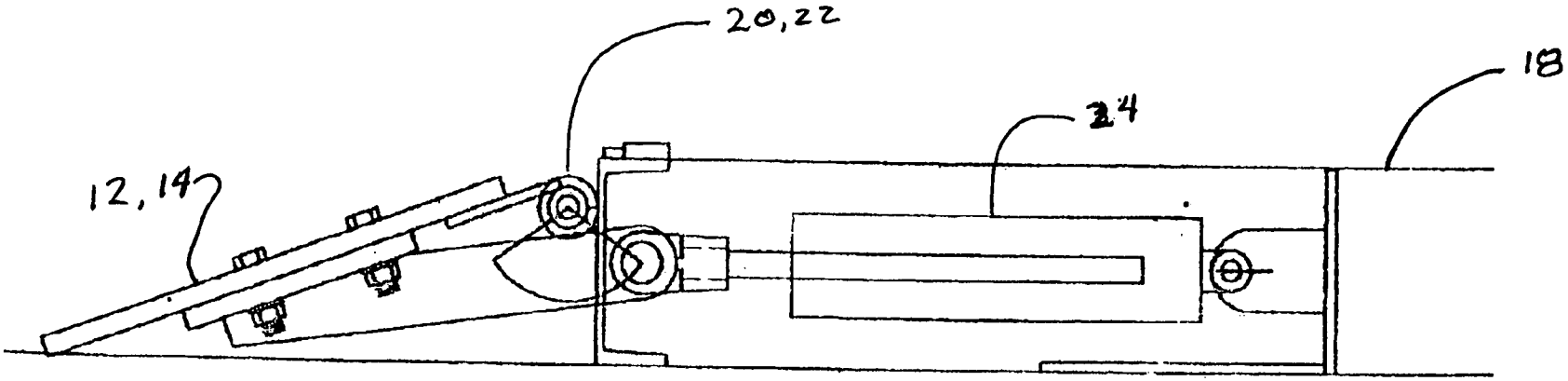
FIG. 6 is a side view of another embodiment of the side illustrated in FIGS. 3-5.
Figure 9:
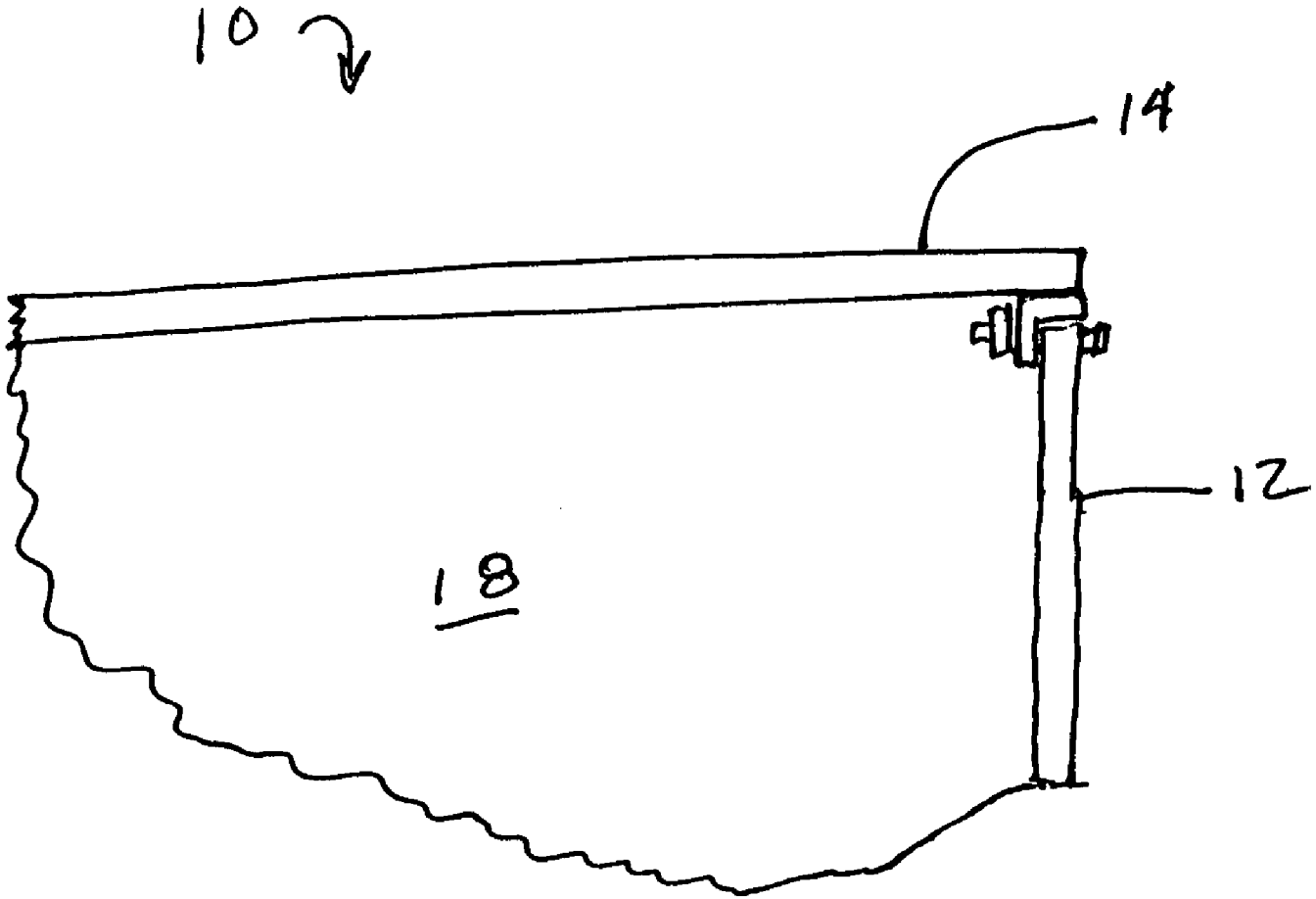
FIG. 9 is a partial top view of the system of FIGS. 1-7.

Now, additionally referring to FIG. 9, there is shown a top view of a corner of system 10. When vehicle 8 is properly located on floor 18, control system 60 is used to activate the raising of sides 12 and 14 as shown in FIGS. 3-5. The sequencing is such that the raising of sidewalls 12 is accomplished first and then endwalls 14 are raised so that the corners seal as illustrated in FIG. 9. Wall 14 places pressure on the flexible seal thereby preventing the loss of fluid therethrough.

Figure 10:
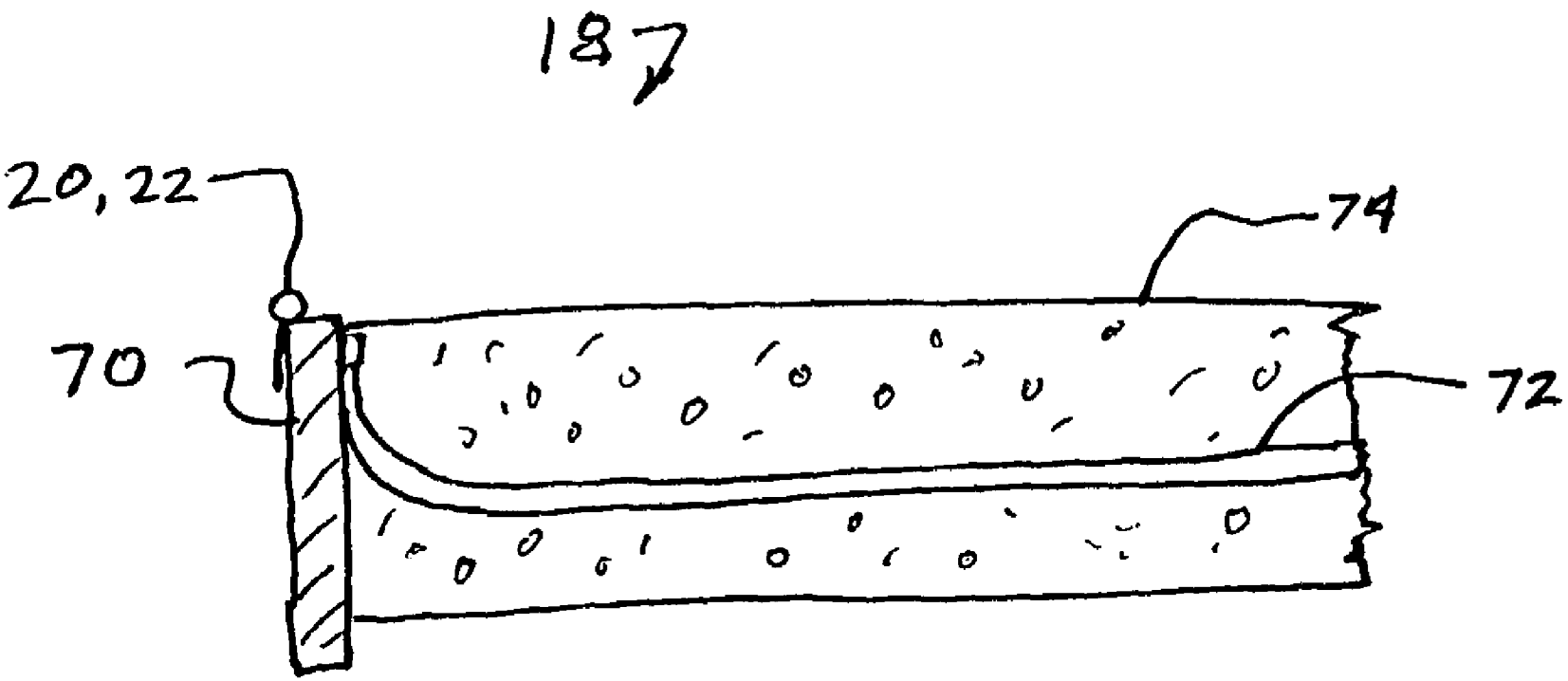
FIG. 10 is a partial sectioned view of the floor of the system of FIGS. 1-7 and 9.

Now, additionally referring to FIG. 10, there is illustrated the construct of floor 18, there is shown a metal frame 70, a membrane 72, and top layer 74. Concrete or some other suitable supporting structure is placed against metal frame 70, and membrane 72 is laid thereon. Membrane 72 is sealed along an edge of frame 70, and layer 74 is arranged on top of membrane 72. Steel frame 70 provides a form for the pouring of concrete, which may constitute the material of layer 74. Membrane 72 is laid upon a concrete or other fill material poured within frame 70 and provides an impermeable membrane 72 against fuel that may otherwise seep into or through layer 74. The resiliency of layer 74 withstands the abuses of weather and the driving thereover by vehicles. Membrane 72, which may be sensitive to effects of the environment such as sunlight, is thus shielded therefrom by being positioning within layer 74.

While walls 12 and 14 are illustrated as rotating into position, they may arrive at a substantially vertical position by movement in another manner such as extending from a recess in the apparatus.

While walls 12 and 14 are illustrated and discussed as each moving to a vertical position so as to contain a potential petroleum spill, sidewalls 12 may be permanently positioned as vertical sides with only endwalls 14 rotating into a substantially vertical position when in use and then serving as inclined planes to facilitate the movement of truck 8 onto and off of system 10. Additionally, a system is contemplated in which sidewalls 12 and one of endwalls 14 are permanently in a vertical position and only one endwall 14 rotates into a vertical position. This allows for fewer moving parts and is attractive for applications in which truck 8 moves onto system 10 in one direction then retraces its path to leave system 10. The most likely use of this embodiment is in an industrial area where the advantages of having all of the sides recline to allow use of a surface, such as a parking lot, is not needed.

While this invention has been described as having a preferred design, the present invention can be further modified within the spirit and scope of this disclosure. This application is therefore intended to cover any variations, uses, or adaptations of the invention using its general purpose and principles. Further, this application is intended to cover such departures from the present disclosure as come within known or customary practices in the art to which this invention pertains.

What is claimed is:

1. A spilled fuel containment apparatus, comprising:

a drive-on substrate; and at least one side including a lower edge being substantially vertically extendable, said at least one side being substantially fluidically sealed with said substrate when said at least one side is substantially vertical, said lower edge of said at least one side not being fluidically sealed with said substrate when said at least one side is substantially horizontal, wherein the lower edge of said at least one side is hingedly connected to said drive-on substrate to facilitate the vertically extendability of said at least one side.

2. The apparatus of claim 1, further comprising at least one hinge connected to said at least one side and to an end of said substrate.

3. The apparatus of claim 2, further comprising a control system operatively connected to said at least one side to raise and lower said at least one side.

4. The apparatus of claim 3, further comprising:

at least one drain valve controllably connected to said control system; and at least one drain positioned in said substrate, said at least one drain fluidically coupled to said at least one drain valve, said control system closing said at least one drain valve when said at least one side is substantially vertical.

5. The apparatus of claim 4, further comprising:

a fuel tank; a plumbing system including: a first end fluidically coupled with said fuel tank; a second end one of installed in said substrate and proximate to said substrate; and a fuel valve fluidically coupled to said plumbing system between said first end and said second end.

6. The apparatus of claim 5, wherein said fuel valve is controllably coupled to said control system.

7. The apparatus of claim 6, wherein said fuel valve is opened by said control system when said at least one side is substantially vertical.

8. The apparatus of claim 1, wherein said substrate includes a plurality of layers including a top layer and a non-porous layer beneath said top layer.

9. The apparatus of claim 8, wherein said substrate further includes a metal edge frame that defines a peripheral edge of said substrate, said non-porous layer being connected to said metal edge frame, said top layer being concrete.

10. The apparatus of claim 1, wherein said substrate has a generally rectangular top surface including a first end and an opposite second end, said at least one side including a first side and a second side, said first side being hingedly connected to said first end, said second side being hingedly connected to said second end.

11. The apparatus of claim 10, wherein said substrate further includes a first side edge and a second side edge both being between said first end and said second end, said at least one side further including a third side and a fourth side, said third side being hingedly connected to said first side edge and said fourth side being hingedly connected to said second side edge.

12. The apparatus of claim 1, wherein said at least one side is vertically extendable along an end of said substrate.

13. A method of containing a potential liquid material spill, comprising the steps of:

driving a delivery vehicle onto a floor; and raising at least one side to be substantially vertical, said at least one side including a lower edge being substantially fluidically sealed with said floor when said at least one side is substantially vertical, said lower edge of said at least one side not being fluidically sealed with said floor when said at least one side is not substantially vertical, wherein the lower edge of said at least one side is hingedly connected to said floor to facilitate said raising of said at least one side to be substantially vertical.

14. The method of claim 13, wherein said raising step includes rotating said at least one side to become substantially vertical.

15. The method of claim 13, further comprising the step of closing at least one drain valve fluidally associated with a drain in said floor when said at least one side is substantially vertical.

16. The method of claim 15, further comprising opening a liquid delivery valve associated with a fuel valve fluidically coupled to a liquid storage tank.

17. The method of claim 16, wherein said liquid delivery valve is only opened if said at least one side is substantially vertical.

18. The method of claim 17, wherein said floor includes a plurality of layers including a top layer and a non-porous layer beneath said top layer.

19. The method of claim 18, wherein said floor further includes a metal edge frame that defines a peripheral edge of said floor, said non-porous layer being connected to said metal edge frame, said top layer being concrete.

20. The method of claim 13, wherein said at least one side is vertically extendable along an end of said floor.

* * * * *